US005279351A

United States Patent [19]

Metz

[11] Patent Number: 5,279,351

[45] Date of Patent: Jan. 18, 1994

[54] ELECTROMAGNETIC STIRRING PROCESS FOR CONTINUOUS CASTING

[76] Inventor: Paul Metz, 18, rue J. P. Brasseur, L-1258 Luxembourg, Luxembourg

[21] Appl. No.: 976,698

[22] Filed: Nov. 13, 1992

[30] Foreign Application Priority Data

Nov. 13, 1991 [LU] Luxembourg ..... LU88034

[51] Int. Cl.[5] ..... B22D 27/02

[52] U.S. Cl. ..... 164/468; 164/504

[58] Field of Search ..... 164/468, 504

[56] References Cited

U.S. PATENT DOCUMENTS 4,867,786 9/1989 Saeki et al. .

4,877,079 10/1989 Long et al. .

FOREIGN PATENT DOCUMENTS 0448113 9/1991 European Pat. Off. .

3527387 2/1987 Fed. Rep. of Germany .

2485411 12/1981 France .

62-57750 3/1987 Japan .

*Primary Examiner*—Kuang Y. Lin

*Attorney, Agent, or Firm*—Fishman, Dionne & Cantor

[57] ABSTRACT

An electromagnetic stirring process for continuous casting is presented. According to the present invention, coils of inductors are supplied with a multiphase current so as to create in a molten metal at least one primary rotational movement zone which is offset with respect to a central casting axis. This primary rotational movement zone is also revolved in a secondary gyratory movement around the central casting axis by a cyclic commutation of each phase of the current.

18 Claims, 2 Drawing Sheets

ELECTROMAGNETIC STIRRING PROCESS FOR CONTINUOUS CASTING

BACKGROUND OF THE INVENTION

The present invention relates to methods for stirring molten metal in a continuous casting process, and, more particularly, where, in the continuous casting process, there is induced in a metal flow, defining a central casting axis, a moving electromagnetic induction field by means of an inductor arrangement disposed around the metal flow and supplied with a multiphase current, the field generating in the molten metal at least one movement transverse to the metal flow.

It is well known to carry out electromagnetic stirring in continuous casting in order to obtain greater regularity for the cast metal, both as regards its surface state and its internal properties, such as segregation and shrinkage.

It has thus been proposed to stir the metal either in the ingot mould itself, or at different places below the ingot mould. The exact point of positioning of the various inductors producing the stirring is determined as a function of the casting speed, the casting cross-section, and also of the quality of the metal to be treated.

Two main types of stirrers have hitherto been known:

a) the rotational stirrer which surrounds as symmetrically as possible the metal which is cast or is to be cast and acts perpendicularly to the flow of the metal; such a stirrer is for example described in the printed patent specification FR-A-2,279,500 which is incorporated herein by reference;

b) the directional linear stirrer which acts most often parallel to the flow of the metal; such a stirrer is for example described in the German journal "Fachberichte Huttenpraxis Metallverarbeitung", Vol. 25, No. 7, 1987, p. 676–681 "Electromagnetic Stirring using Voest-Alpine Pulsators on the Donawitz Continuous Bloom Caster" which is incorporated herein by reference. The latter type of stirrer may act either on only one surface of the cast metal, or on two diametrically opposed surfaces, or even on the four surfaces of the metal. It has also been proposed to use the latter type of linear inductor while applying pulses to it which are intended to generate an additional stirring of the metal to be treated.

The printed patent specification FR-A-2,485,411, which is incorporated herein by reference, and U.S. Pat. No. 4,867,786, which is also incorporated herein by reference, propose using linear inductors on two opposing faces of the metal. These inductors are then electrically divided into successive elementary inductive units producing juxtaposed rotational movements, rotating pairwise in opposing directions. The method relates essentially to metal products with an elongated quadrilateral cross-section.

It has also been proposed to generate in the metal to be treated, by means of rotational stirrers, a helicoid movement in order to entrain the inclusions contained in the liquid metal upwards. Such a method has for example been described in the printed patent specification FR-A-2,426,516 (corresponding to U.S. Pat. No. 4,281,263 the disclosure of both of which are incorporated herein by reference). This method has not however found an application because it hinders correct lubrication of the ingot mould.

Printed patent specification DE-A-3,527,387, which is incorporated herein by reference, proposes using two rotating magnetic fields, working at different frequencies and amplitudes. The objective sought is to create two different coaxial rotational movements wherein the external movement has a lower speed of rotation than the internal movement It will be noted that the axis of rotation of the two movements coincides with the central casting axis. In the same way as conventional rotational stirring, this method has, among the others, the disadvantage of creating a movement similar to a vortex at the center of the internal movement, when it is desired to intensify the stirring movements.

U.S. Pat. No. 4,877,079, which is incorporated herein by reference, proposes juxtapositioning, in the molten metal flow, two rotational movements of opposite rotation directions, so as to create, at the interface of the two movements, a material flow transverse to the central casting axis. The combined action of these movements consequently leads to better movement of the bath at the center of the metal flow. The main drawback of this method is the orientation of the movement along one dominant direction, which is certainly not optimal from the point of view of cross-sectional homogeneity of the structure of the metal.

It is consequently noted that, although it is true that the various techniques hitherto employed have contributed to an improvement of the internal and external structure of the continuously cast products, it is nonetheless true that the various types of stirring used lead to new non-negligible drawbacks. Thus it has, for example, been noticed that rotational and linear stirrers, used both in the ingot mould itself and beneath the ingot mould, can at a certain moment entrain in the metal to be treated movements promoting the creation of defects, for example: the formation of inclusions and white lines, or deterioration of the internal structure at the central segregation.

SUMMARY OF THE INVENTION

The above-discussed and other drawbacks and deficiencies of the prior art are overcome or alleviated by the electromagnetic stirring method for continuous casting of the present invention. In accordance with the electromagnetic stirring method of the present invention, coils of an inductor arrangement are supplied with a multiphase current so as to create in a bath of molten metal at least one primary rotational movement zone which is offset with respect to a central casting axis, and in which a cyclic commutation of phases of the multiphase current is produced so as to revolve this at least one primary rotational movement zone in a secondary gyratory movement around the central casting axis.

While, with the present invention, it is possible to create a single primary circumscribed movement offset with respect to the central casting axis of the metal and to rotate it around this axis, it is also possible to create two primary movement zones with opposing directions of rotation which are juxtaposed, each of these zones extending preferably from the edge of the metal flow as far as the central casting axis. At their interface, the two primary movements are superimposed, thus intensifying the flow through the central regions. The secondary gyratory movement guarantees that this central flow does not have a dominant direction.

The multiphase current used is advantageously a three-phase current, or a two-phase current, respectively supplying for example a six coil or eight coil inductor system.

It will also be appreciated that it is possible to superimpose on the primary rotational movement and/or on the secondary gyratory movement a helicoid movement along the casting axis, without hindering correct lubrication of the ingot mould.

In another embodiment, applicable to a metal flow with a square cross-section, eight coils disposed in pairs along the four sides of the metal flow are supplied with a two-phase current.

The method is advantageously applicable to electromagnetic stirring in a cooled ingot mould, with circular, square, rectangular or other cross-sections, with or without a central immersed nozzle. It may however also be applied to stirring in the various zones situated below the ingot mould of the continuous casting. It is also suitable to point out that the proposed method may be applied to the continuous casting of any known metal, such as steel, aluminum, copper, etc. It will be understood that the proposed method does not in most cases require modification of inductors already installed, it is actually sufficient to modify or replace the electrical supply or respectively to complete it by installing adequate commutation.

Another feature of the present invention is to improve the quality of the internal and external structure of continuously cast metals by providing a novel method of stirring which is particularly effective.

The present invention provides an excellent distribution of movements in the flow of the metal while avoiding movement exclusively around the casting axis which is disadvantageous since such movement produces a vortex tube entraining inclusions or powders towards the center. A unidirectional movement passing through the central casting axis, which makes it practically impossible to use immersed nozzles, is also avoided. It will also be understood that the distribution of the movements promotes exchange of material between the peripheral regions and the central regions of the metal flow, without favouring a particular direction. In this way, excellent cross-sectional homogeneity of the structure is obtained.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
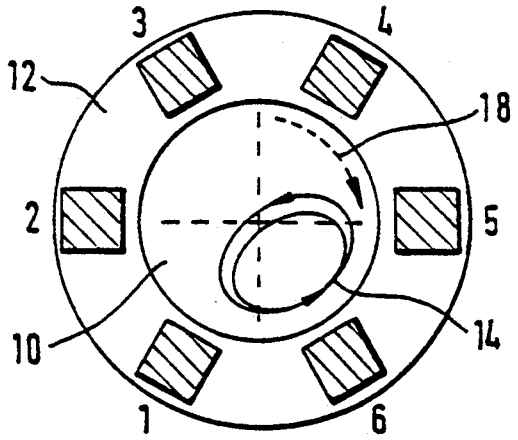
FIG. 1 schematically represents a cross-section through a molten metal flow and coils according to the present invention showing movements in the bath with a single primary rotational movement.
Figure 2:
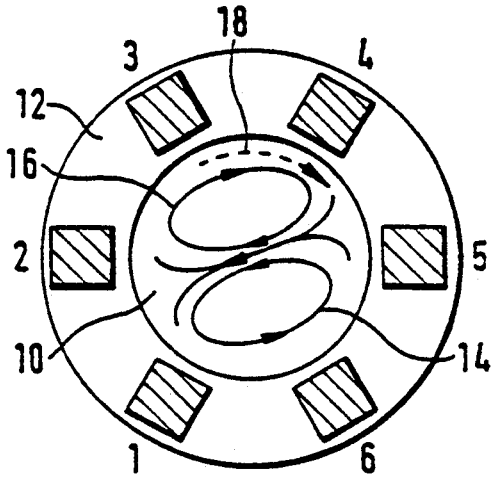
FIG. 2 is a schematical representation of metal flow of FIG. 1, showing movements in the bath including two primary rotational movements of opposing directions.

Referring generally to FIGS. 1 through 4, depicted generally at 10 is a horizontal cross-section through either an ingot mould or a billet or a bloom underneath an ingot mould including a metal flow having a first movement which is illustrated as perpendicular to the plane of the FIGURES and which has a central axis which is also perpendicular to the plane of the FIGURES. The cross-section of metal flow 10 may for example, be square (FIGS. 5 and 6), rectangular (FIGS. 5 and 6) or circular (FIGS. 1 and 2). It will be understood that the molten metal is undergoing solidification from its periphery.

Inductor 12 is provided and may be of the electromagnetic type which is well known in the art. This inductor 12 may for example, include an annular frame, in one or more pieces, surrounding the metal flow 10. The inductor 12 comprises, as shown in FIGS. 1 or 2 for example, six coils, numbered 1 to 6, which may be excited selectively in order to induce an electromagnetic field in the molten metal. While six coils are illustrated it will be understood that any suitable number of coils may be utilized Coils 1–6, schematically represented in the FIGURES by rectangles, may be part of the same annular inductor or be divided into several groups of coils belonging to several different inductors. The inductor may have salient poles or non-salient poles.

FIG. 1 schematically illustrates, for a circular cross-section, the stirring movements obtained by using a single offset primary circumscribed movement zone (or a second movement) 14. This movement zone 14 is, in the case shown in FIG. 1, generated by a sliding (or moving) field produced by an excitation of coil 1, coil 6 and coil 5 with respectively a first phase, a second phase and a third phase of a three phase current. It will be noted that movement zone 14 is offset with respect to the central casting axis. According to the method proposed there is then imposed on the movement zone 14 in FIG. 1, in its entirety, a gyratory movement (or a third movement) 18 around the central casting axis.

In order to make movement zone 14 in FIG. 1 revolve around the central casting axis in the sense of arrow 18, it is sufficient to produce a commutation of the phases so as to generate the following sequence of excitation cycles of the coils 1 to 6: (1-6-5), (2-1-6), (3-2-1), (4-3-2), (5-4-3), (6-5-4), (1-6-5), etc.

Instead of rotating the movement zone 14 clockwise, it will be understood that rotation in the reverse direction is accomplished by cyclically exciting the coils in a sequence which is the reverse of that mentioned above. It may furthermore be understood that it may be advantageous to reverse the direction of the movement 18 and/or of the movement 14 from time to time.

FIG. 2 shows, for the device in FIG. 1, the creation of a second primary rotational movement zone (or a fourth movement) 16. Movement zone 16 is diametrically juxtaposed to the first primary rotational movement zone 14, but has a direction of rotation opposite to the latter. The movement zone 16, as depicted in FIG. 2, is generated by an excitation of the coils 2, 3 and 4 with a three-phase current, whereas the first movement zone 14 is, still in the case represented in FIG. 2, generated by an excitation of the coils 1, 6, 5 with a three-phase current. As in the case in FIG. 1, a gyratory movement 18 around the casting axis is then imposed on the primary rotation movement zones 14 and 16 (FIG. 2).

Figure 3:
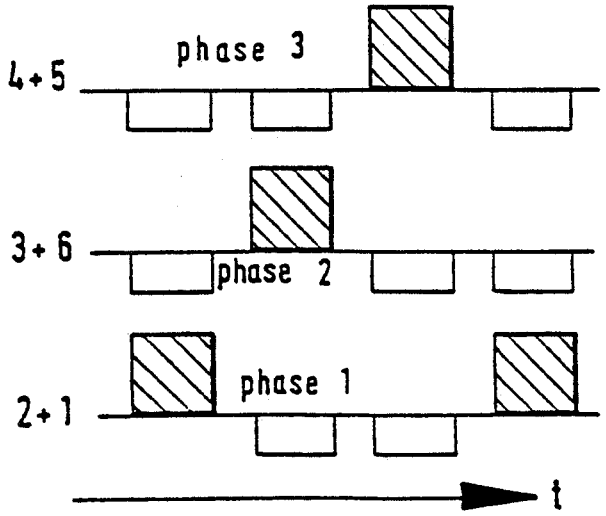
FIG. 3 is a diagrammatical view of a distribution in time of three-phase currents in the various coils in FIG. 2.

The graph in FIG. 3 schematically represents the distribution of three-phase current among coils 1 to 6 during a first cycle. It will be understood that during this first cycle, which generates the movement zones 14 and 16 represented in FIG. 2, coils 1 and 2 are connected to phase 1, coils 3 and 6 to phase 2 and coils 4 and 5 to phase 3. The abscissa of the graph in FIG. 3 represents time. The blocks represent the current in the phases as a function of time. This diagram illustrates how to supply the coils in order to create, in the case in FIG. 2, the two shifting fields which are displaced from 2 to 3 to 4, and from 1 to 6 to 5 respectively, driving the liquid metal and thus generating the offset movement zones 14 and 16.

In order to create the gyratory movement 18 around the central casting axis, the connection of the phases to the various coils need only be changed. Thus during the second cycle, coils 3 and 2 will be connected to phase 1, coils 4 and 1 to phase 2 and coils 6 and 5 to phase 3. The rotational movement zones 14 and 16 will thus be displaced by a predetermined angle around the casting axis. This angle depends in particular on the number and configuration of the coils of the stirrer. In the above-mentioned case this angle may be for example 60°, so that a 360° rotation around the central casting axis requires six cycles similar to that represented in FIG. 3.

The speed of rotation of this gyratory movement around the casting axis is in particular a function of this angle and of the duration of the individual cycles. The latter may be continuously variable, within limits imposed by the electrical installation. In practice, the speed of secondary rotation will for example be chosen as a function of the position of the inductor or inductors in the casting installation. Normally, the speed of secondary rotation is between 5 and 200 revolutions per minute. The frequency of the multiphase supply current will itself be chosen as a function of the position of the inductor or inductors. In fact, the inductor or inductors situated at the ingot mould will principally work in the range of low frequencies (2 to 15 Hz) capable of passing through the walls of the copper ingot mould, whereas inductors situated underneath the ingot mould will be able to work at higher frequencies, for example between 15 and 70 Hz.

It will be appreciated that it is also possible to superimpose on the secondary gyratory movement and on the primary rotational movement, which are characteristic of the proposed method, .a helicoid movement along the casting axis. For this purpose, the coil winding will be given, for example, in a manner which is well known, an asymmetry which induces in the metal such a helicoid movement, or the various pole pieces of the inductor or inductors will be staggered, in a manner which is also well known, in the vertical direction. It will be appreciated that the lubrication of the mould will thus be noticeably improved in comparison with the poor lubrication of the ingot mould obtained during the application of a helicoid movement to the conventional rotational stirring.

Figure 4:
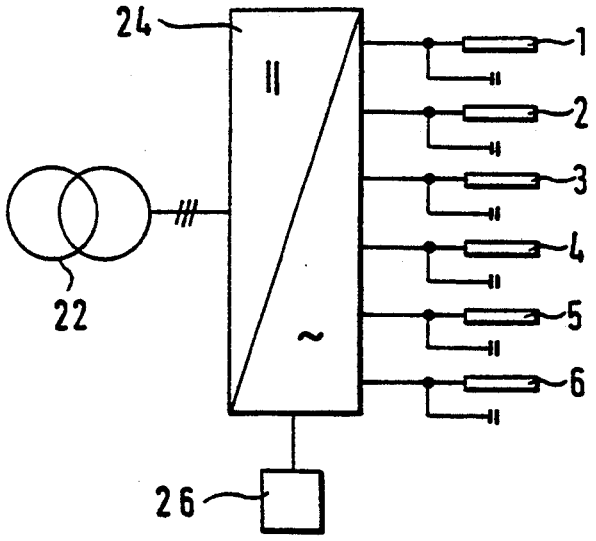
FIG. 4 is a schematic showing a three phase supply for a six coil stirrer according to the present invention.

There are numerous variants of multiphase supply systems and of phase commutation possibilities. FIG. 4 represents, by way of non-limiting example, a three phase supply system for a six coil inductor, the coils being numbered 1 to 6. Each coil is supplied through a current converter circuit 24 which is well known. The latter is connected to a three-phase 50 Hz (or 60 Hz) power distribution 22 and delivers as an output a three-phase system with variable frequency and amplitude. An electronic selector 26, which is well known, allows commutating the phase-coil combinations according to a predefined sequence.

Figure 5:
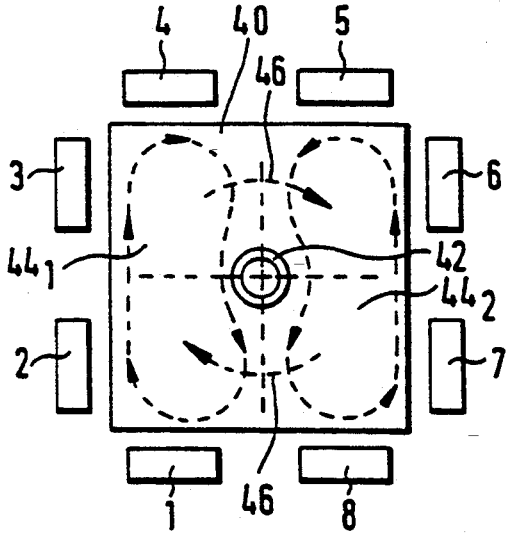
FIGS. 5 and 6 are schematics showing the movements in the bath in a square cross-sectional ingot mould according to the present invention, fitted with a eight coil stirrer.
Figure 6:
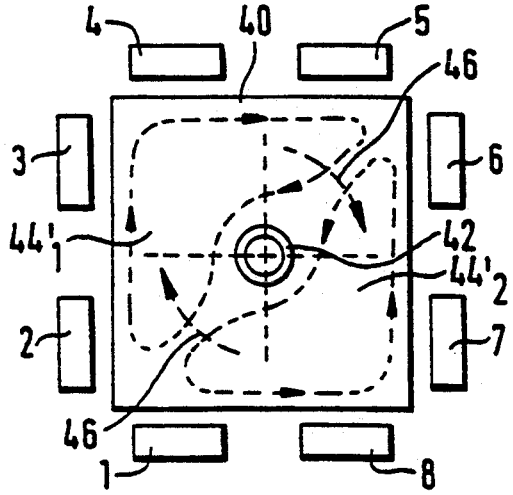

FIGS. 5 and 6 schematically illustrate, by way of example, a particular embodiment of the electromagnetic stirring method proposed, applied to an ingot mould 40 with a square cross section. This ingot mould is for example water-cooled and includes an immersed nozzle 42. At each one of four sides of the ingot mould 40, coils are provided, all eight of which belong to one or more inductors. The supply is made with a two-phase current, so as to obtain sliding fields generating offset primary movement zones $44_1$, $44_2$ in the cross section of the ingot mould 40.

FIG. 5 schematically illustrates the movements in said cross section transverse to the metal flow, during a first excitation cycle of the eight coils. It will be noted that primary movement zones $44_1$ and $44_2$ symmetrical in relation to a median plan. The first phase is connected to the coils 1 and 3, respectively 8 and 6. The second phase is connected to the coils 2 and 4, respectively 7 and 5.

FIG. 6 schematically illustrates, in a view similar to FIG. 5, the movements during the next cycle. It will be understood that the primary movement zones $44'_1$ and $44'_2$ are now symmetrical in relation to a diagonal plan. The first phase is connected to the coils 2 and 4, respectively 1 and 7. The second phase is connected to the coils 3 and 5, respectively 8 and 6.

The arrows labelled by reference 46 in FIGS. 5 and 6 show the direction of the gyratory movement of the primary movement zones $44_1$ and $44_2$ around the immersed nozzle 42. It will be appreciated that the revolving primary movement zones $44_1$ and $44_2$ will allow excellent stirring conditions. The rather slow gyratory movement will not produce the central vortex tube entraining the covering slag by suction, which is a well known drawback of prior art rotational stirrers. It will also be appreciated that the erosion of the immersed nozzle is substantially reduced, because there is no longer a predominant direction of movement in the bath.

The invention has been described by way of illustration with reference to vertical casting. It may however be applied with the same advantages to oblique or even horizontal casting.

It will be noted from the above description that the stirring method proposed allows all the requisite movements of modern continuous casting to be produced in a particularly simple and effective manner, without presenting drawbacks of the stirring methods which are known in the state of the art.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A process for stirring a molten metal flow of a continuous casting, the molten metal flow having a first movement in a first direction, the molten metal flow having a central axis along said first movement in said first direction, the process employing a machine for stirring the molten metal flow comprising an inductor arrangement having a plurality of coils disposed about the molten metal flow, said coils adapted for receiving a multiphase current and generating a moving electromagnetic induction field for effecting a second movement in the molten metal flow, said coils also adapted for cyclically commutating the phases of the multiphase current for effecting a third movement in the molten metal flow, the process comprising the steps of:

(1) generating in the molten metal flow said second movement in a generally transverse direction to said first direction and generally offset with respect to said central axis;

(2) generating said third movement wherein said second movement is rotated about said central axis.

2. The process of claim 1 further comprising the step of:

generating with said moving electromagnetic induction field a fourth movement disposed opposite said central axis from said second movement, said fourth movement in a generally transverse direction to said first direction and said fourth movement generally offset with respect to said central axis.

3. The process of claim 2 wherein:

said second movement is in a generally clockwise direction and said fourth movement is in a generally counterclockwise direction.

4. The process of claim 1 wherein said multiphase current is a three-phase current.

5. The process of claim 4 wherein said plurality of coils comprises six coils symmetrically disposed around the metal flow.

6. The process of claim 1 wherein said multiphase current is a two-phase current.

7. The process of claim 6 wherein said plurality of coils comprises eight coils disposed around the metal flow.

8. The process of claim 7 wherein:

said molten metal flow has a square cross section; and said eight coils are disposed in pairs around each side of the molten metal flow.

9. The process of claim 1 wherein said third movement is generally helicoidal in shape.

10. A process for stirring a molten metal flow of a continuous casting, the molten metal flow having a first movement in a first direction, the molten metal flow having a central axis along said first movement in said first direction, comprising the steps of:

(1) exciting a plurality of coils of an inductor arrangement by a multiphase current to induce a moving electromagnetic induction field for effecting a second movement in a generally transverse direction to said first direction and generally offset with respect to said central axis; and (2) exciting said plurality of coils of said inductor arrangement by cyclically commutating the phases of said multiphase current to effect a third movement including said second movement being rotated about said central axis.

11. The process of claim 10 further comprising the step of:

exciting said plurality of coils of said inductor arrangement by said multiphase current to effect a fourth movement disposed opposite said central axis from said second movement, said fourth movement in a generally transverse direction to said first direction and said fourth movement generally offset with respect to said central axis.

12. The process of claim 11 wherein:

said second movement is in a generally clockwise direction and said fourth movement is in a generally counterclockwise direction.

13. The process of claim 10 wherein said multiphase current is a three-phase current.

14. The process of claim 13 wherein said plurality of coils comprises six coils symmetrically disposed around the metal flow.

15. The process of claim 10 wherein said multiphase current is a two-phase current.

16. The process of claim 15 wherein said plurality of coils comprises eight coils disposed around the metal flow.

17. The process of claim 16 wherein:

said molten metal flow has a square cross section; and said eight coils are disposed in pairs around each side of the molten metal flow.

18. The process of claim 10 wherein said third movement is generally helicoidal in shape.

* * * * *